US009431001B2

(12) United States Patent
Cherkassky et al.

(10) Patent No.: US 9,431,001 B2
(45) Date of Patent: Aug. 30, 2016

(54) DEVICE, SYSTEM AND METHOD OF NOISE CONTROL

(75) Inventors: Daniel Cherkassky, Rishon Lezion (IL); Jossef Barath, Herzliya (IL); Ofira Rubin, Nizanei Oz (IL)

(73) Assignee: SILENTIUM LTD., Rehovot (IL)

( * ) Notice: Subject to any disclaimer, the term of this patent is extended or adjusted under 35 U.S.C. 154(b) by 1006 days.

(21) Appl. No.: 13/468,170

(22) Filed: May 10, 2012

(65) Prior Publication Data

US 2012/0288110 A1 Nov. 15, 2012

Related U.S. Application Data

(60) Provisional application No. 61/484,722, filed on May 11, 2011.

(51) Int. Cl.
*G10K 11/178* (2006.01)

(52) U.S. Cl.
CPC ... *G10K 11/1786* (2013.01); *G10K 2210/1282* (2013.01); *G10K 2210/3014* (2013.01); *G10K 2210/30231* (2013.01); *G10K 2210/505* (2013.01)

(58) Field of Classification Search
CPC ..... G10K 11/16; G10K 11/178; G10K 11/1786; G10K 2210/128; G10K 2210/1282; G10K 2210/12821; G10K 2210/12822; G10K 2210/30231; G10K 2210/3014; G10K 2210/505
USPC ..... 381/71.1, 71.4, 71.11, 71.13, 56, 57, 381/317, 73.1
See application file for complete search history.

(56) References Cited

U.S. PATENT DOCUMENTS

| | | | |
|---|---|---|---|
| 2,043,416 | A | 6/1936 | Lueg |
| 2,091,774 | A | 8/1937 | Weiland |
| 4,025,724 | A | 5/1977 | Davidson, Jr. et al. |
| 4,665,549 | A | 5/1987 | Eriksson et al. |
| 4,965,832 | A | 10/1990 | Edwards et al. |

(Continued)

FOREIGN PATENT DOCUMENTS

| | | |
|---|---|---|
| EP | 0615224 | 9/1994 |
| EP | 0759606 | 2/1997 |

(Continued)

OTHER PUBLICATIONS www.worksafe.wa.gov.au/newsite/worksafe/default.html, 2 pages.

(Continued)

*Primary Examiner* — Davetta W Goins
*Assistant Examiner* — Daniel Sellers
(74) *Attorney, Agent, or Firm* — Shichrur & Co.

(57) ABSTRACT

Some demonstrative embodiments include devices, systems and methods of noise control. For example, a device may include a controller to control noise within a predefined noise-control zone, the controller is to receive a plurality of noise inputs representing acoustic noise at a plurality of predefined noise sensing locations, which are defined with respect to the predefined noise-control zone, to receive a plurality of residual-noise inputs representing acoustic residual-noise at a plurality of predefined residual-noise sensing locations, which are located within the predefined noise-control zone, to determine a noise control pattern, based on the plurality of noise inputs and the plurality of residual-noise inputs, and to output the noise control pattern to at least one acoustic transducer.

21 Claims, 8 Drawing Sheets

(56) References Cited

U.S. PATENT DOCUMENTS

| | | | | |
|---|---|---|---|---|
| 5,117,401 | A | 5/1992 | Feintuch | |
| 5,182,774 | A | 1/1993 | Bourk | |
| 5,216,722 | A | 6/1993 | Popovich | |
| 5,253,486 | A | 10/1993 | Sugahara et al. | |
| 5,271,062 | A | 12/1993 | Sugita et al. | |
| 5,325,437 | A * | 6/1994 | Doi et al. | 381/71.9 |
| 5,343,713 | A | 9/1994 | Okabe et al. | |
| 5,347,586 | A | 9/1994 | Hill et al. | |
| 5,365,594 | A | 11/1994 | Ross et al. | |
| 5,377,275 | A | 12/1994 | Suzuki | |
| 5,410,607 | A | 4/1995 | Mason et al. | |
| 5,471,537 | A | 11/1995 | Castwall | |
| 5,475,731 | A | 12/1995 | Rasmusson | |
| 5,475,761 | A | 12/1995 | Eatwell | |
| 5,478,199 | A | 12/1995 | Gliebe | |
| 5,511,127 | A | 4/1996 | Warnaka | |
| 5,519,637 | A | 5/1996 | Mathur | |
| 5,553,154 | A | 9/1996 | Tamamura et al. | |
| 5,568,557 | A | 10/1996 | Ross et al. | |
| 5,602,926 | A | 2/1997 | Ohashi et al. | |
| 5,602,927 | A | 2/1997 | Tamamura et al. | |
| 5,606,622 | A | 2/1997 | Christenson | |
| 5,613,009 | A | 3/1997 | Miyazaki et al. | |
| 5,618,010 | A | 4/1997 | Pla et al. | |
| 5,627,896 | A | 5/1997 | Southward et al. | |
| 5,636,286 | A | 6/1997 | Makabe et al. | |
| 5,680,393 | A | 10/1997 | Bourmeyster et al. | |
| 5,680,450 | A | 10/1997 | Dent et al. | |
| 5,694,476 | A | 12/1997 | Klippel | |
| 5,745,731 | A | 4/1998 | Kim et al. | |
| 5,748,748 | A * | 5/1998 | Fischer et al. | 381/71.4 |
| 5,748,749 | A | 5/1998 | Miller et al. | |
| 5,768,398 | A | 6/1998 | Janse et al. | |
| 5,812,973 | A | 9/1998 | Wang | |
| 5,937,070 | A | 8/1999 | Todter et al. | |
| 5,978,489 | A | 11/1999 | Wan | |
| 6,005,952 | A | 12/1999 | Klippel | |
| 6,078,671 | A | 6/2000 | Kawanishi et al. | |
| 6,084,971 | A | 7/2000 | McLean | |
| 6,160,392 | A | 12/2000 | Shin | |
| 6,160,892 | A | 12/2000 | Ver | |
| 6,181,753 | B1 | 1/2001 | Takada et al. | |
| 6,201,872 | B1 | 3/2001 | Hersh et al. | |
| 6,330,336 | B1 | 12/2001 | Kasama | |
| 6,351,532 | B1 | 2/2002 | Takada et al. | |
| 6,496,581 | B1 | 12/2002 | Finn et al. | |
| 6,535,609 | B1 | 3/2003 | Finn et al. | |
| 6,700,977 | B2 | 3/2004 | Sugiyama | |
| 6,891,347 | B2 | 5/2005 | Dobbs et al. | |
| 6,895,094 | B1 | 5/2005 | Scalart et al. | |
| 6,944,304 | B1 | 9/2005 | Dance et al. | |
| 7,017,702 | B2 | 3/2006 | Gunby | |
| 7,017,707 | B2 | 3/2006 | Zia et al. | |
| 7,039,207 | B1 | 5/2006 | Elrod et al. | |
| 7,161,801 | B2 | 1/2007 | Chen et al. | |
| 7,167,363 | B1 | 1/2007 | Cushman et al. | |
| 7,317,801 | B1 | 1/2008 | Amir | |
| 7,353,908 | B1 | 4/2008 | French | |
| 7,853,024 | B2 | 12/2010 | Slapak et al. | |
| 8,630,424 | B2 | 1/2014 | Slapak et al. | |
| 8,855,329 | B2 | 10/2014 | Slapak et al. | |
| 2001/0044719 | A1 * | 11/2001 | Casey | 704/245 |
| 2002/0080978 | A1 | 6/2002 | Kakuhari et al. | |
| 2002/0154481 | A1 | 10/2002 | Wagner | |
| 2003/0053635 | A1 | 3/2003 | Carme et al. | |
| 2003/0103635 | A1 | 6/2003 | Wright et al. | |
| 2003/0107873 | A1 | 6/2003 | Van Gaal | |
| 2003/0112980 | A1 | 6/2003 | Vaishya | |
| 2003/0123675 | A1 | 7/2003 | Culman et al. | |
| 2004/0081322 | A1 * | 4/2004 | Schliep et al. | 381/57 |
| 2004/0210547 | A1 * | 10/2004 | Wentland et al. | 706/46 |
| 2005/0170770 | A1 | 8/2005 | Johnson et al. | |
| 2005/0232435 | A1 | 10/2005 | Stothers et al. | |
| 2006/0188107 | A1 | 8/2006 | Inoue et al. | |
| 2007/0003071 | A1 | 1/2007 | Slapak et al. | |
| 2008/0317254 | A1 | 12/2008 | Kano | |
| 2010/0014685 | A1 | 1/2010 | Wurm | |
| 2010/0028134 | A1 | 2/2010 | Slapak et al. | |
| 2010/0104110 | A1 | 4/2010 | Asao et al. | |
| 2010/0131269 | A1 | 5/2010 | Park et al. | |
| 2010/0138427 | A1 * | 6/2010 | Van De Par et al. | 707/748 |
| 2013/0133128 | A1 | 5/2013 | Hein et al. | |
| 2014/0116632 | A1 | 5/2014 | Domash | |

FOREIGN PATENT DOCUMENTS

| | | |
|---|---|---|
| EP | 0818771 | 1/1998 |
| EP | 0903726 | 3/1999 |
| EP | 0973151 | 1/2000 |
| EP | 1414021 | 4/2004 |
| EP | 2 119 628 | 11/2009 |
| EP | 2 251 860 | 11/2010 |
| JP | 06282279 | 10/1994 |
| JP | H08296335 A | 11/1996 |
| JP | 2001067081 | 3/2001 |
| JP | 2001092469 | 4/2001 |
| JP | 2009029405 | 2/2009 |
| WO | 92 05538 | 4/1992 |
| WO | 9531805 | 11/1995 |
| WO | 00/047012 | 8/2000 |
| WO | 02/32356 | 4/2002 |
| WO | 2005/027338 | 3/2005 |
| WO | 2009078146 | 6/2009 |

OTHER PUBLICATIONS http://en.wikibooks.org/wiki/Acoustics/Noise_from_Cooling_Fans, 6 pages.

International Search Report for PCT/IL07/00269, mailed on Sep. 22, 2008, 1 page.

International Search Report for PCT/IL07/00270, mailed on Sep. 16, 2008, 1 page.

European Search Report for European Patent Application No. EP 02 02 3483, mailed on Apr. 8, 2003, 2 pages.

Office Action for European Patent Application No. EP 02 02 3483, mailed on Jan. 31, 2005, 4 pages.

Office Action for European Patent Application No. EP 0202 3483, mailed on Apr. 11, 2005, 4 pages.

Office Action for European Patent Application No. EP 0202 3483, mailed on Jul. 27, 2006, 3 pages.

International Search Report for PCT/IL04/00863, mailed on Feb. 25, 2005, 1 page.

International Search Report for PCT/IL08/00087, mailed on Sep. 23, 2008, 1 page.

European Search Report for European Patent Application No. 07713290.0, mailed on Feb. 28, 2013, 8 pages.

Office Action for U.S. Appl. No. 10/573,060, mailed on Oct. 2, 2008, 16 pages.

Office Action for U.S. Appl. No. 10/573,060, mailed on Apr. 30, 2009, 17 pages.

Office Action for U.S. Appl. No. 10/573,060, mailed on Sep. 4, 2009, 19 pages.

Office Action for U.S. Appl. No. 10/573,060, mailed on Feb. 4, 2010, 22 pages.

Office Action for Korean Patent Application No. 10-2006-7007389, mailed on Feb. 24, 2011, 10 pages, including 4 pages of English translation.

Office Action for U.S. Appl. No. 09/120,973, mailed on Jul. 17, 2003, 10 pages.

Office Action for U.S. Appl. No. 09/120,973, mailed on Sep. 12, 2003, 8 pages.

Office Action for U.S. Appl. No. 09/120,973, mailed on Mar. 24, 2004, 7 pages.

Office Action for U.S. Appl. No. 09/120,973, mailed on Jul. 12, 2004, 8 pages.

Office Action for U.S. Appl. No. 09/120,973, mailed on Dec. 16, 2004, 9 pages.

Office Action for U.S. Appl. No. 09/120,973, mailed on Dec. 15, 2005, 7 pages.

(56) References Cited

OTHER PUBLICATIONS

Office Action for U.S. Appl. No. 11/606,010, mailed on Nov. 24, 2009, 23 pages.
Office Action for U.S. Appl. No. 11/606,010, mailed on Sep. 17, 2008, 20 pages.
Office Action for U.S. Appl. No. 11/606,010, mailed on Jul. 7, 2009, 25 pages.
Office Action for U.S. Appl. No. 11/606,010, mailed on Apr. 1, 2009, 22 pages.
Office Action for U.S. Appl. No. 12/941,145, mailed on Nov. 13, 2012, 6 pages.
Office Action for U.S. Appl. No. 12/941,145, mailed on Mar. 25, 2013, 6 pages.
Office Action for U.S. Appl. No. 12/941,145, mailed on Jul. 1, 2013, 12 pages.
International Preliminary Report on Patentability for International Application No. PCT/IL2008/000087, mailed on Sep. 23, 2008, 9 pages.
International Search Report and Written Opinion for PCT/IB12/52333, mailed on Nov. 14, 2012, 16 pages.
International Preliminary Report on Patentability for PCT/IB12/52333, mailed on Nov. 21, 2013, 8 pages.
Office Action for U.S. Appl. No. 12/449,068, mailed on Jun. 24, 2013, 33 pages.
Office Action for U.S. Appl. No. 12/449,068, mailed on Jan. 30, 2014, 37 pages.
Office Action for Chinese Patent Application No. 201280026024.3, mailed on Jan. 7, 2015, 18 pages, including 9 pages of English translation.
Extended European Search Report for European Patent Application No. 12782754.1, mailed on Aug. 20, 2015, 7 pages.
Sen M Kuo et al., "Active Noise Control: A Tutorial Review," Proceedings of the IEEE, IEEE, vol. 87, No. 6, Jun. 1999, XP011044219, pp. 943-973, 31 pages, New York, USA.
Office Action and Search Report of Chinese Patent Application No. 2012800260243, mailed on Sep. 17, 2015, 15 pages (including 7 pages of English translation).
International Search Report and Written Opinion for PCT/IB2015/059996, mailed on May 5, 2016, 10 pages.
Office Action for Japanese Patent Application Serial No. 2014509878, mailed on May 24, 2016, 12 pages (including 6 pages of English translation.).

* cited by examiner

DEVICE, SYSTEM AND METHOD OF NOISE CONTROL

CROSS-REFERENCE

This application claims the benefit of and priority from U.S. Provisional Patent application No. 61/484,722, entitled "Device, System and Method of Noise Control", filed May 11, 2011, the entire disclosures of which is incorporated herein by reference.

BACKGROUND

Noise in general, and tonal noise in particular is very annoying. Low-frequency noise is very penetrating, travels very long distances and is difficult to attenuate using traditional passive control measures.

Passive noise control technology, which usually involves using absorptive materials or noise partitions, enclosures, barriers and silencers, can be bulky, ineffective and rather expensive at low frequencies. Active Noise Control (ANC), on the other hand, can be very efficient and relatively cheaper in reducing low-frequency noise.

Active Noise Control (ANC) is a technology using noise to reduce noise. It is based on the principle of superposition of sound waves. Generally, sound is a wave, which is traveling in space. If another, second sound wave having the same amplitude but opposite phase to the first sound wave can be created, the first wave can be totally cancelled. The second sound wave is named "anti-noise".

SUMMARY

Some demonstrative embodiments include devices, systems and methods of noise control.

In some demonstrative embodiments, an active noise control system may include a controller to control noise within a predefined noise-control zone, the controller is to receive a plurality of noise inputs representing acoustic noise at a plurality of predefined noise sensing locations, which are defined with respect to the predefined noise-control zone, to receive a plurality of residual-noise inputs representing acoustic residual-noise at a plurality of predefined residual-noise sensing locations, which are located within the predefined noise-control zone, to determine a noise control pattern, based on the plurality of noise inputs and the plurality of residual-noise inputs, and to output the noise control pattern to at least one acoustic transducer.

In some demonstrative embodiments, the controller may include an extractor to extract from the plurality of noise inputs a plurality of disjoint reference acoustic patterns, which are statistically independent, wherein the controller may determine the noise control pattern based on at least one disjoint reference acoustic pattern of the plurality of disjoint reference acoustic patterns.

In some demonstrative embodiments, the controller may select the at least one disjoint reference acoustic pattern from the plurality of disjoint reference acoustic patterns based on one or more predefined acoustic pattern attributes of at least one predefined noise pattern to be controlled within the noise-control zone.

In some demonstrative embodiments, the acoustic pattern attributes comprise at least one attribute selected from the group consisting of amplitude, energy, phase, frequency, direction, and statistical properties.

In some demonstrative embodiments, the controller may extract the plurality of disjoint reference acoustic patterns by applying a predefined extraction function to the plurality of noise inputs.

In some demonstrative embodiments, the controller is to determine the noise control pattern to reduce at least one noise parameter within the noise-control zone, the noise parameter including at least one parameter selected from the group consisting of energy and amplitude.

In some demonstrative embodiments, the controller is to determine the noise control pattern to selectively reduce one or more predefined first noise patterns within the noise-control zone, while not reducing one or more second noise patterns within the noise-control zone.

In some demonstrative embodiments, the noise-control zone is located within an interior of a vehicle, wherein the one or more first noise patterns include at least one pattern selected from the group consisting of a road noise pattern, a wind noise pattern, and an engine noise pattern, and wherein the one or more first noise patterns include at least one pattern selected from the group consisting of an audio noise pattern of an audio device located within the vehicle, a horn noise pattern, and a siren noise pattern Or any other functional/hazard signals.

In some demonstrative embodiments, the controller is to determine the noise control pattern without having information relating to one or more noise-source attributes of one or more actual noise sources generating the acoustic noise at the plurality of predefined noise sensing locations.

In some demonstrative embodiments, the noise-source attributes include at least one attribute selected from the group consisting of a number of the noise sources, a location of the noise sources, a type of the noise sources, and one or more attributes of one or more noise patterns generated by one or more of the noise sources.

In some demonstrative embodiments, the noise sensing locations are distributed on an enclosure surrounding the noise-control zone.

In some demonstrative embodiments, the system includes one or more first acoustic sensors to sense the acoustic noise at one or more of the plurality of noise sensing locations; and one or more second acoustic sensors to sense the acoustic residual-noise at one or more of the plurality of residual-noise sensing locations.

In some demonstrative embodiments, a method of active noise control may include determining acoustic noise at a plurality of predefined noise sensing locations, which are defined with respect to a predefined noise-control zone; determining acoustic residual-noise at a plurality of predefined residual-noise sensing locations, which are located within the predefined noise-control zone; determining a noise control pattern to control the acoustic noise within the noise-control zone, based on the acoustic noise at the plurality of predefined noise sensing locations and the acoustic residual-noise at the plurality of predefined residual-noise sensing locations; and outputting the control pattern to at least one acoustic transducer.

In some demonstrative embodiments, a method of noise control may include determining a noise control pattern to control acoustic noise within a predefined noise-control zone, based on acoustic noise at a plurality of predefined noise sensing locations, which are defined with respect to the predefined noise-control zone, and acoustic residual-noise at a plurality of predefined residual-noise sensing locations, which are located within the predefined noise-control zone; and outputting the control pattern to at least one acoustic transducer.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1:
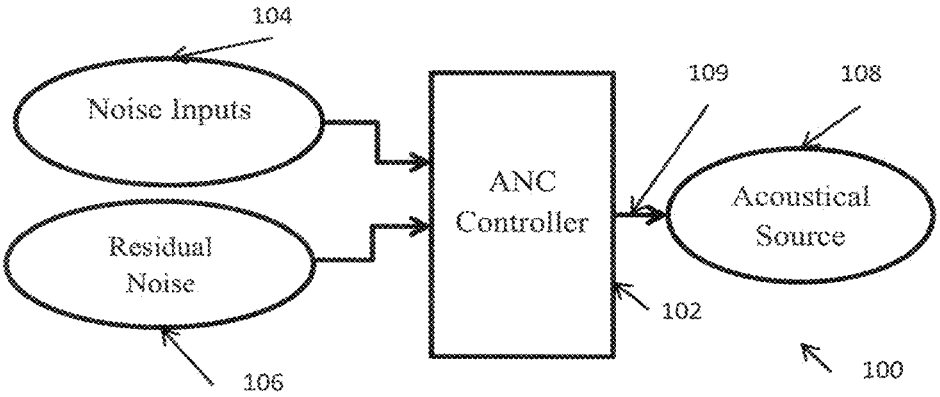
FIG. 1 is a schematic block diagram illustration of an Active Noise Control (ANC) system, in accordance with some demonstrative embodiments.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Discussions herein utilizing terms such as, for example, "processing", "computing", "calculating", "determining", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" and "a plurality" as used herein include, for example, "multiple" or "two or more". For example, "a plurality of items" includes two or more items.

Some portions of the following detailed description are presented in terms of algorithms and symbolic representations of operations on data bits or binary digital signals within a computer memory. These algorithmic descriptions and representations may be the techniques used by those skilled in the data processing arts to convey the substance of their work to others skilled in the art.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Some demonstrative embodiments include systems and methods, which may be efficiently implemented for controlling noise, for example, reducing or eliminating undesirable noise, e.g., at least noise of generally low frequencies, as described below.

Some demonstrative embodiments may include methods and/or systems of Active Noise Control (ANC) configured to control, reduce and/or eliminate the noise energy and/or wave amplitude of one or more acoustic patterns ("primary patterns") produced by one or more noise sources, which may include known and/or unknown noise sources.

In some demonstrative embodiments, an ANC system may be configured to produce a noise control pattern ("secondary pattern"), e.g., including a destructive noise pattern, which may be based on one or more of the primary patterns, for example, such that a controlled noise zone, for example, a reduced noise zone, e.g., a quiet zone, may be created by a combination of the secondary and primary patterns.

In some demonstrative embodiments, the ANC system may be configured to control, reduce and/or eliminate noise within a predefined location, area or zone ("the noise-control zone", also referred to as the "quiet zone" or "Quiet Bubble™"), without, for example, regardless of and/or without using a-priori information regarding the primary patterns and/or the one or more noise sources.

For example, the ANC system may be configured to control, reduce and/or eliminate noise within the noise control zone, e.g., independent of, regardless of and/or without knowing in advance one or more attributes of one or more of the noise sources and/or one or more of the primary patterns, for example, the number, type, location and/or other attributes of one or more of the primary patterns and/or one or more of the noise sources.

Some demonstrative embodiments are described herein with respect to ANC systems and/or methods configured to reduce and/or eliminate the noise energy and/or wave amplitude of one or more acoustic patterns within a quiet zone.

However, in other embodiments the ANC systems and/or methods may be configured to control in any other manner the noise energy and/or wave amplitude of one or more acoustic patterns within the noise control zone, for example, to affect, alter and/or modify the noise energy and/or wave amplitude of one or more acoustic patterns within a predefined zone.

In one example, the ANC systems and/or methods may be configured to selectively reduce and/or eliminate the noise energy and/or wave amplitude of one or more types of acoustic patterns within the noise control zone and/or to selectively increase and/or amplify the noise energy and/or wave amplitude of one or more other types of acoustic patterns within the noise control zone; and/or to selectively maintain and/or preserve the noise energy and/or wave amplitude of one or more other types of acoustic patterns within the noise control zone.

In some demonstrative embodiments, the ANC system may be configured to control reduce and/or eliminate the noise energy and/or wave amplitude of one or more of the primary patterns within the quite zone.

In some demonstrative embodiments, the ANC system may be configured to control, reduce and/or eliminate noise within the noise control zone in a selective and/or configurable manner, e.g., based on one or more predefined noise pattern attributes, such that, for example, the noise energy, wave amplitude, phase, frequency, direction and/or statistical properties of one or more first primary patterns may be affected by the secondary pattern, while the secondary pattern may have a reduced effect or even no effect on the noise energy, wave amplitude, phase, frequency, direction and/or statistical properties of one or more second primary patterns, e.g., as described below.

In some demonstrative embodiments, the ANC system may be configured to control, reduce and/or eliminate the noise energy and/or wave amplitude of the primary patterns on a predefined envelope or enclosure surrounding and/or enclosing the noise control zone.

In one example, the noise control zone may include a two-dimensional zone, e.g., defining an area in which the noise energy and/or wave amplitude of one or more of the primary patterns is to be controlled, reduced and/or eliminated.

According to this example, the ANC system may be configured to control, reduce and/or eliminate the noise energy and/or wave amplitude of the primary patterns along a perimeter surrounding the noise control zone.

In one example, the noise control zone may include a three-dimensional zone, e.g., defining a volume in which the noise energy and/or wave amplitude of one or more of the primary patterns is to be controlled, reduced and/or eliminated. According to this example, the ANC system may be configured to control, reduce and/or eliminate the noise energy and/or wave amplitude of the primary patterns on a surface enclosing the three-dimensional volume.

In one example, the noise control zone may include a spherical volume and the ANC system may be configured to control, reduce and/or eliminate the noise energy and/or wave amplitude of the primary patterns on a surface of the spherical volume.

In another example, the noise control zone may include a cubical volume and the ANC system may be configured to control, reduce and/or eliminate the noise energy and/or wave amplitude of the primary patterns on a surface of the cubical volume.

In other embodiments, the noise control zone may include any other suitable volume, which may be defined, for example, based on one or more attributes of a location at which the noise control zone is to be maintained.

Figure 2:
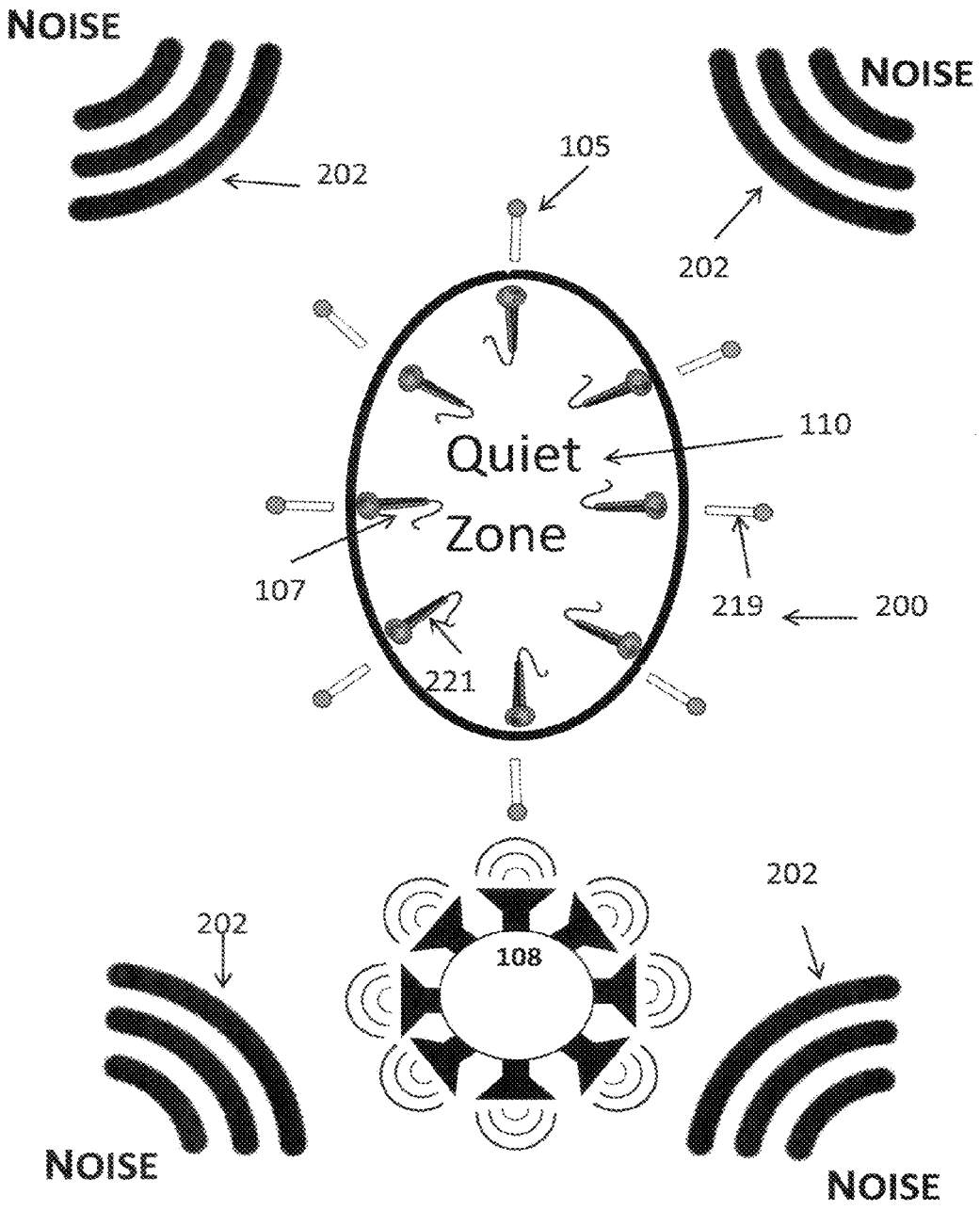
FIG. 2 is a schematic illustration of a deployment scheme of components of the ANC system of FIG. 1, in accordance with some demonstrative embodiments.

Reference is now made to FIG. 1, which schematically illustrates an ANC system 100, in accordance with some demonstrative embodiments. Reference is also made to FIG. 2, which schematically illustrates of a deployment scheme 200 of components of ANC system 100, in accordance with some demonstrative embodiments.

In some demonstrative embodiments, ANC system 100 may include a controller 102 to control noise within a predefined noise-control zone 110, e.g., as described in detail below.

In some demonstrative embodiments, noise control zone 110 may include a three-dimensional zone. For example, noise control zone 110 may include a spherical zone.

In some demonstrative embodiments, controller 102 may be configured to receive a plurality of noise inputs 104 representing acoustic noise at a plurality of predefined noise sensing locations 105, which are defined with respect to noise-control zone 110.

In some demonstrative embodiments, controller 102 may receive noise inputs 104 from one or more acoustic sensors, e.g., microphones, accelerometers, tachometers and the like, located at one or more of locations 105, and/or from one or more virtual sensors configured to estimate the acoustic noise at one or more of locations 105, e.g., as described in detail below.

In some demonstrative embodiments, controller 102 may be configured to receive a plurality of residual-noise inputs 106 representing acoustic residual-noise at a plurality of predefined residual-noise sensing locations 107, which are located within noise-control zone 110.

In some demonstrative embodiments, controller 102 may receive residual-noise inputs 106 from one or more acoustic sensors, e.g., microphones, accelerometers tachometers and the like, located at one or more of locations 107, and/or from one or more virtual sensors configured to estimate the residual-noise at one or more of locations 107, e.g., as described in detail below.

In some demonstrative embodiments, ANC 100 may include at least one acoustic transducer 108, e.g., a speaker. Controller 102 may control acoustic transducer 108 to generate an acoustic noise control pattern configured to control the noise within noise control zone 110, e.g., as described in detail below.

In some demonstrative embodiments, controller 102 may be configured to determine a noise control signal 109, based on noise inputs 104 and residual-noise inputs 106, and to output noise control signal 109 to control acoustic transducer 108, e.g., as described in detail below.

In some demonstrative embodiments, the at least one acoustic transducer 108 may include, for example, an array of one or more acoustic transducers, e.g., at least one suitable speaker, to produce the noise control pattern based on noise control signal 109.

In some demonstrative embodiments, the at least one acoustic transducer 108 may be positioned at one or more locations, which may be determined based on one or more attributes of noise control zone 110, e.g., a size and/or shape of zone 110, one or more expected attributes inputs 104, one or more expected attributes of one or more potential actual noise sources 202, e.g., an expected location and/or directionality of noise sources 202 relative to noise control zone 110, a number of noise sources 202, and the like.

In one example, acoustic transducer 108 may include a speaker array including a predefined number, denoted M, of speakers or a multichannel acoustical source. For example, acoustic transducer 108 include speaker Part No. AI 4.0, available from Cerwin-Vega Inc., Chatsworth, Calif., and the like.

In some demonstrative embodiments, acoustic transducer 108 may include an array of speakers implemented using a suitable "compact acoustical source" positioned at a suitable location, e.g., external to zone 110. In another example, the array of speakers may be implemented using a plurality of speakers distributed in space, e.g., around noise control zone 110.

In some demonstrative embodiments, locations 105 may be distributed externally to noise control zone 110. For example, one or more of locations 105 may be distributed on, or in proximity to, an envelope or enclosure surrounding noise control zone 110.

For example, if noise control zone 110 is defined by a spherical volume, then one or more of locations 105 may be distributed on a surface of the spherical volume and/or external to the spherical volume.

In another example, one or more of locations 105 may be distributed in any combination of locations on and/or external to the spherical volume, e.g., one or more locations surrounding the spherical volume.

In some demonstrative embodiments, locations 107 may be distributed within noise control zone 110, for example, in proximity to the envelope of noise control zone 110.

For example, if quiet zone 110 is defined by a spherical volume, then locations 107 may be distributed on a spherical surface having a radius, which is lesser than a radius of noise control zone 110.

In some demonstrative embodiments, ANC system 100 may include one or more first acoustic sensors ("primary sensors") to sense the acoustic noise at one or more of the plurality of noise sensing locations 105.

In some demonstrative embodiments, ANC system 100 may include one or more second acoustic sensors ("error sensors") to sense the acoustic residual-noise at one or more of the plurality of residual-noise sensing locations 107.

In some demonstrative embodiments, one or more of the error sensors and/or one or more of the primary sensors may be implemented using one or more "virtual sensors" ("virtual microphones"). A virtual microphone corresponding to a particular microphone location may be implemented by any suitable algorithm and/or method capable of evaluating an acoustic pattern, which would have be sensed by an actual acoustic sensor located at the particular microphone location.

In some demonstrative embodiments, controller 102 may be configured to simulate and/or perform the functionality of the virtual microphone, e.g., by estimating and/or evaluating the acoustic noise pattern at the particular location of the virtual microphone.

In some demonstrative embodiments, ANC system 100 may include a first array 219 of one or more primary sensors, e.g., microphones, accelerometers, tachometers and the like, configured to sense the primary patterns at one or more of locations 105. For example, the primary sensors may include one or more sensors to sense the primary patterns on a spherical surface defining a spherical noise control zone 110.

For example, array 219 may include microphone Part No. ECM6AP, available from ARIO Electronics Co. Ltd., Taoyuan, Taiwan. The microphone may output a noise signal 104 including, for example, a sequence of N samples per second. For example, N may be 41100 samples per second, e.g., if the microphone operates at a sampling rate of about 44.1 KHz. The noise signal 104 may include any other suitable signal having any other suitable sampling rate and/or any other suitable attributes.

In some demonstrative embodiments, one or more of the sensors of array 219 may be implemented using one or more "virtual sensors". For example, array 219 may be implemented by a combination of at least one microphone and at least one virtual microphone. A virtual microphone corresponding to a particular microphone location of locations 105 may be implemented by any suitable algorithm and/or method, e.g., as part of controller 102 or any other element of system 100, capable of evaluating an acoustic pattern, which would have be sensed by an acoustic sensor located at the particular microphone location. For example, controller 102 may be configured to evaluate the acoustic pattern of the virtual microphone based on at least one actual acoustic pattern sensed by the at least one microphone of array 219.

In some demonstrative embodiments, ANC system 100 may include a second array 221 of one or more error sensors, e.g., microphones, configured to sense the acoustic residual-noise at one or more of locations 107. For example, the error sensors may include one or more sensors to sense the acoustic residual-noise patterns on a spherical surface within spherical noise control zone 110.

In some demonstrative embodiments, one or more of the sensors of array 221 may be implemented using one or more "virtual sensors". For example, array 221 may include a combination of at least one microphone and at least one virtual microphone. A virtual microphone corresponding to a particular microphone location of locations 107 may be implemented by any suitable algorithm and/or method, e.g., as part of controller 102 or any other element of system 100, capable of evaluating an acoustic pattern, which would have be sensed by an acoustic sensor located at the particular microphone location. For example, controller 102 may be configured to evaluate the acoustic pattern of the virtual microphone based on at least one actual acoustic pattern sensed by the at least one microphone of array 221.

In some demonstrative embodiments, the number, location and/or distribution of the locations 105 and/or 107, and/or the number, location and/or distribution of one or more acoustic sensors at one or more of locations 105 and 107 may be determined based on a size of noise control zone 110 or of an envelope of noise control zone 110, a shape of noise control zone 110 or of the envelope of noise control zone 110, one or more attributes of the acoustic sensors to be located at one or more of locations 105 and/or 107, e.g., a sampling rate of the sensors, and the like.

In one example, one or more acoustic sensors, e.g., microphones, accelerometers, tachometers and the like, may be deployed at locations 105 and/or 107 according to the Spatial Sampling Theorem, e.g., as defined below by Equation 1.

For example, a number of the primary sensors, a distance between the primary sensors, a number of the error sensors and/or a distance between the error sensors may be determined in accordance with the Spatial Sampling Theorem, e.g., as defined below by Equation 1.

In one example, the primary sensors and/or the error sensors may be distributed, e.g., equally distributed, with a distance, denoted d, from one another. For example, the distance d may be determined as follows:

$$d \leq \frac{c}{2 \cdot f} \tag{1}$$

wherein c denotes the speed of sound and $f_{max}$ denotes a maximal frequency at which noise control is desired.

For example, in case the maximal frequency of interest is $f_{max}$=100 [Hz], the distance d may be determined as $$d \leq \frac{343}{2 \cdot 100} = 1.7[m].$$

As shown in FIG. 2 deployment scheme 200 is configured with respect to a circular or spherical noise control zone 110. For example, locations 105 are distributed, e.g., substantially evenly distributed, in a spherical or circular manner around noise control zone 110, and locations 107 are distributed, e.g., substantially evenly distributed, in a spherical or circular manner within noise control zone 110.

However in other embodiments, components of ANC system 100 may be deployed according to any other deployment scheme including any suitable distribution of locations 105 and/or 107, e.g., configured with respect a noise control zone of any other suitable form and/or shape.

In some demonstrative embodiments, controller 102 may be configured to determine the noise control pattern to be reduced according to at least one noise parameter, e.g., energy, amplitude, phase, frequency, direction, and/or statistical properties within noise-control zone 110, e.g., as described in detail below.

In some demonstrative embodiments, controller 102 may determine the noise control pattern to selectively reduce one or more predefined first noise patterns within noise-control zone 110, while not reducing one or more second noise patterns within noise-control zone 110, e.g., as described below.

In one demonstrative embodiment, noise-control zone 110 may be located within an interior of a vehicle, and controller 102 may determine the noise control pattern to selectively reduce one or more first noise patterns, e.g., including a road noise pattern, a wind noise pattern, and/or an engine noise pattern, while not reducing one or more second noise patterns, e.g., including an audio noise pattern of an audio device located within the vehicle, a horn noise pattern, a siren noise pattern, a hazard noise pattern of a hazard, an alarm noise pattern of an alarm signal, a noise pattern of an informational signal, and the like.

In some demonstrative embodiments, controller 102 may determine the noise control pattern without having information relating to one or more noise-source attributes of one or more of actual noise sources 202 generating the acoustic noise at the noise sensing locations 105.

For example, the noise-source attributes may include a number of noise sources 202, a location of noise sources 202, a type of noise sources 202 and/or one or more attributes of one or more noise patterns generated by one or more of noise sources 202.

In some demonstrative embodiments, controller 102 may be configured to extract from the plurality of noise inputs 104 a plurality of disjoint reference acoustic patterns, which are statistically independent.

For example, controller 102 may include an extractor to extract the plurality of disjoint reference acoustic patterns, e.g., as described below with reference to FIG. 4.

The phrase "disjoint acoustic patterns" as used herein may refer to a plurality of acoustic patterns, which are independent with respect to at least one feature and/or attribute, e.g., energy, amplitude, phase, frequency, direction, one or more statistical signal properties, and the like.

In some demonstrative embodiments, controller 102 may extract the plurality of disjoint reference acoustic patterns by applying a predefined extraction function to the plurality of noise inputs 104, e.g., as described below with reference to FIG. 4.

In some demonstrative embodiments, the extraction of the disjoint acoustic patterns may be used, for example, to model the primary pattern of inputs 104 as a combination of the predefined number of disjoint acoustic patterns, e.g., corresponding to a respective number of disjoint modeled acoustic sources.

This modeling may be useful, for example, in order to increase an efficiency, e.g., a computational efficiency, reduce a complexity, e.g., a mathematical and/or computational complexity, which may result from processing the primary pattern, without, having, for example, a-priori information regarding the primary pattern and/or the one or more actual noise sources 202.

Additionally or alternatively, the extraction of the disjoint acoustic patterns may enable selectively controlling noise within noise control zone 110, e.g., according to one or more predefined noise attributes and/or types, e.g., as described below.

In some demonstrative embodiments, controller 102 may determine the noise control signal 109 for generating the noise control pattern based on at least one disjoint reference acoustic pattern of the plurality of disjoint reference acoustic patterns.

In some demonstrative embodiments, controller 102 may select the at least one disjoint reference acoustic pattern ("the selected reference acoustic pattern") from the plurality of disjoint reference acoustic patterns based, for example, on one or more predefined acoustic pattern attributes of at least one predefined noise pattern to be controlled within noise-control zone 110.

In some demonstrative embodiments, the acoustic pattern attributes may include an amplitude, energy, phase, frequency, direction, and/or one or more statistical signal properties of the predefined noise pattern.

In some demonstrative embodiments, the predefined acoustic pattern attributes may relate to expected and/or estimated attributes of an expected noise pattern to be affecting noise control zone 110.

In one example, ANC system 100 may be implemented in an environment, e.g., a room, in which a user may want to hear acoustic signals of a first type, e.g., a television located within the room, while reducing and/or eliminating acoustic signals of a second type, e.g., noise from outside of the room. According to this example, controller 102 may be configured to model inputs 104 into first and second disjoint acoustic patterns corresponding to the first and second types of acoustic signals, respectively. Controller 102 may then generate noise control signal 109 to selectively reduce and/or cancel the acoustic signals of the second type, e.g., while substantially not affecting the acoustic signals of the first type.

In another example, if ANC system 100 is deployed within the interior of a vehicle, it may be expected that one or more expected noise patterns, which are expected to affect noise-control zone 110, may be generated by one or more of road noise, wind noise, engine noise and the like. Accordingly, controller 102 may be configured to select one or more reference acoustic patterns based on one or more attributes of the road noise pattern, the wind noise pattern, and/or the engine noise pattern.

Figure 3:
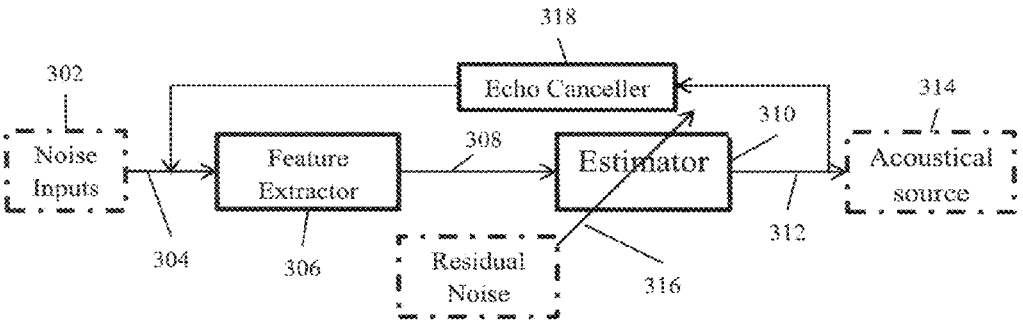
FIG. 3 is a schematic block diagram illustration of a controller, in accordance with some demonstrative embodiments.

Reference is now made to FIG. 3, which schematically illustrates a controller 300, in accordance with some demonstrative embodiments. In some embodiments, controller 300 may perform, for example, the functionality of controller 102 (FIG. 1).

In some demonstrative embodiments, controller 300 may receive a plurality of inputs 304, e.g., including inputs 104 (FIG. 1), representing acoustic noise at a plurality of predefined noise sensing locations, e.g., locations 105 (FIG. 2), which are defined with respect to a noise-control zone, e.g., noise control zone 110 (FIG. 2). Controller 300 may generate a noise control signal 312 to control at least one acoustic transducer 314, e.g., acoustic transducer 108 (FIG. 1).

In some demonstrative embodiments, controller 300 may include an estimator ("prediction unit") 310 to estimate noise signal 312 by applying an estimation function to an input 308 corresponding to inputs 304.

In some demonstrative embodiments, e.g., as shown in FIG. 3, controller may include an extractor 306 to extract a plurality of disjoint reference acoustic patterns from inputs 304, e.g., as described below. According to these embodiments, input 308 may include the plurality of disjoint reference acoustic patterns.

In some demonstrative embodiments, controller 300 may use the extraction of the disjoint acoustic patterns to model the noise represented by inputs 304 as a combination of a predefined number of disjoint modeled acoustic sources generating the predefined number of disjoint acoustic patterns, respectively. This modeling may be useful, for example, in order to increase an efficiency, e.g., a computational efficiency, reduce a complexity, e.g., a mathematical and/or computational complexity, of controller 300, which may result, for example, from processing inputs 304, without, having, for example, a-priori information regarding attributes of inputs 304 and/or attributes of one or more noise sources generating and/or affecting inputs 304.

Additionally or alternatively, controller 300 may utilize the disjoint acoustic patterns 308 to reduce and/or eliminate noise within the noise control zone 110 (FIG. 2) in a selective and/or configurable manner, e.g., based on one or more predefined noise pattern attributes.

For example, controller 300 may be configured to generate noise control signal 312 based on the disjoint acoustic patterns such that, for example, the noise control signal 312 may affect the noise energy and/or wave amplitude of one or more first primary patterns in a first manner, while the noise energy and/or wave amplitude of one or more second primary patterns may be affected in a second, different manner.

In one example, controller 300 may generate noise control signal 312 configured to reduce and/or eliminate the noise energy and/or wave amplitude of the first primary patterns within the noise control zone, while the noise energy and/or wave amplitude of the first primary patterns may not be affected within the noise control zone.

In some demonstrative embodiments, extractor 306 may be configured to extract noise patterns related to one or more "unwanted" noise sources and/or patterns, which may be predefined based on any suitable attributes. Controller 300 may generate noise control signal 312 such that, for example, only a specific portion of the unwanted noise will be destructed by the pattern produced by the transducer 314.

Figure 4:
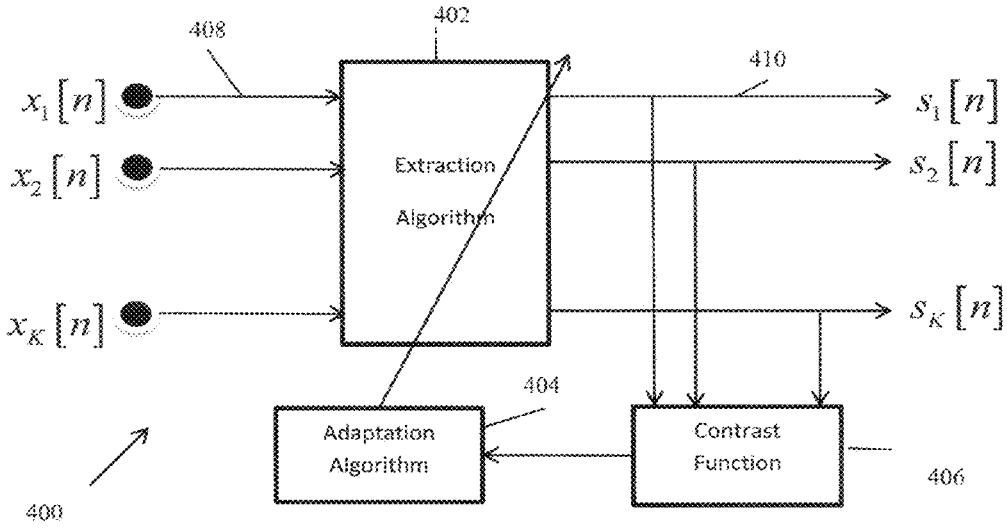
FIG. 4 is a schematic block diagram illustration of an extractor, in accordance with some demonstrative embodiments.

Reference is now made to FIG. 4, which schematically illustrates an extractor 400, in accordance with some demonstrative embodiments. In some demonstrative embodiments, extractor 400 may perform the functionality of extractor 306 (FIG. 3).

In some demonstrative embodiments, extractor 400 may receive a plurality of inputs 408, e.g., including inputs 104 (FIG. 1), representing acoustic noise at a plurality of predefined noise sensing locations, e.g., locations 105 (FIG. 2), which are defined with respect to a noise-control zone, e.g., noise control zone 110 (FIG. 2). Extractor 400 may extract from inputs 408 a plurality of disjoint reference acoustic patterns 410, e.g., as described in detail below.

In some demonstrative embodiments, extractor 400 may apply an extraction algorithm 402 to inputs 408.

In some demonstrative embodiments, extraction algorithm 402 may represent, for example, noise sources disaggregated by a suitable statistical approach, e.g., Independent Component Analysis (ICA) also known in the art as Blind Source Separation (BSS), and the like.

In some demonstrative embodiments, extractor 400 may include an adaptation algorithm 404 to adapt one or more parameters of extraction algorithm 402, e.g., based on at least one predetermined criterion. For example, adaptation algorithm 404 may be able to minimize, a statistical dependence between disjoint reference acoustic patterns 410, e.g., Mutual Information (MI), as discussed below.

In some demonstrative embodiments, the plurality of inputs 408 may include a predefined number, denoted K', of inputs corresponding to a respective plurality of K' noise sensing locations, e.g., locations 105 (FIG. 2).

In some demonstrative embodiments, extraction algorithm 402 may generate disjoint reference acoustic patterns 410 including a predefined number, denoted K, of disjoint reference acoustic patterns 410.

In some demonstrative embodiments, extraction algorithm 402 may determine the K disjoint reference acoustic patterns 410 corresponding to a current sample of the noise at the K' noise sensing locations.

In some demonstrative embodiments, extraction algorithm 402 may determine the K disjoint reference acoustic patterns 410 corresponding to the current sample, based on the current sample of the noise at the K' noise sensing locations, and taking into account one or more successive previous samples of the noise at the K' noise sensing locations, e.g., a predefined number, denoted I, of the noise at the K' noise sensing locations.

For example, inputs 408 corresponding to an n-th sample, may be represented by a matrix, denoted X[n], which includes the n-th sample of the noise at the K' noise sensing locations, and I successive previous samples of the noise at the K' noise sensing locations. For example, inputs 408 may be represented as follows:

$$X[n] = \begin{pmatrix} x_1[n] & \dots & x_1[n-I] \\ \vdots & \ddots & \vdots \\ x_{K'}[n] & \dots & x_{K'}[n-I] \end{pmatrix} \tag{2}$$

In some demonstrative embodiments, extraction algorithm 402 may generate disjoint reference acoustic patterns 410, by applying an extraction function to the inputs 408, e.g. as follows:

$$\hat{S}[n]=F^{-1}(X[n]) \tag{3}$$

wherein $F^{-1}$ denotes the extraction function, and wherein $\hat{S}[n]$ denotes a vector of the K disjoint reference acoustic patterns 410 corresponding to the n-th sample. For example, the vector $\hat{S}[n]$ may be represented as follows:

$$S[n] = \begin{pmatrix} s_1[n] \\ \vdots \\ s_K[n] \end{pmatrix} \tag{4}$$

In some demonstrative embodiments, the function $F^{-1}$ may include a memory-less function, e.g., with respect to previous samples, or a function having an element of memory.

For example, the vector $\hat{S}[n]$ may be represented as follows, e.g., using a memoryless function:

$$\hat{S}[n] = F^{-1}\begin{pmatrix} x_1[n] \\ \vdots \\ x_K[n] \end{pmatrix} \tag{5}$$

The vector $\hat{S}[n]$ may be represented, for example, as follows, e.g., using a function with memory:

$$\hat{S}[n] = F^{-1}\begin{pmatrix} x_1[n], & x_1[n-1], & x_1[n-2], \ldots \\ \vdots & \vdots & \vdots \\ x_K[n], & x_K[n-1], & x_K[n-2], \ldots \end{pmatrix} \tag{6}$$

In some demonstrative embodiments, the function $F^{-1}$ may include a linear function, e.g., such that each of the elements of the vector S is a linear combination of elements of the matrix X, or a non-linear function.

For example, an i-th element of the vector $\hat{S}[n]$ may be determined, e.g., as follows:

$$s_i[n] = b_i + \sum_{k=1}^{K} a_{i,k} \cdot x_k \tag{7}$$

In some demonstrative embodiments, the function $F^{-1}$ may be defined based on one or more predefined required attributes of the K disjoint reference acoustic patterns 410, e.g., based on the one or more predefined noise pattern attributes to be controlled within the noise control zone, as described above.

In some demonstrative embodiments, the function $F^{-1}$ may include, for example, a linear mapping function with memory. For example, the operation $F^{-1}(\bullet)$ may denote an operation of convolution, e.g., such that the vector $\hat{S}[n]$ may be determined according to Equation 3 by convolving the function $F^{-1}$ with the matrix X[n].

For example, the vector $\hat{S}[n]$ may be determined by transforming Equation 3 to a Z-domain, e.g., as follows:

$$\hat{S}(z)=B(z)\cdot X(z) \tag{8}$$

wherein B(z) denotes a separation matrix.

For example, extraction algorithm 402 may determine the vector $\hat{S}(z)$ in the z-domain based on a contrast function, denoted $\phi[\hat{S}(z)]$. For example, the contrast function $\phi[\hat{S}(z)]$ may be defined as a Mutual Information (MI) between the outputs $\hat{S}(z)$ of extraction algorithm 402, e.g., as follows:

$$\phi[\hat{S}(Z)] = I(\hat{s}_1, \ldots, \hat{s}_k) = \sum_{k=1}^{K} H(\hat{s}_k) - H(\hat{S}) \tag{9}$$

wherein I denotes an information function, and H denotes Shannon's Entropy. The information function I(X,Y) corresponding to two variables X, Y may be defined, for example, as follows:

$$I(x, y) = \sum_{y \in Y} \sum_{x \in X} p(x, y) \log\left(\frac{p(x, y)}{p(x)p(y)}\right) \tag{10}$$

where p(x,y) denotes a joint probability distribution function of X and Y, and p(x) and p(y) denote the marginal probability distribution functions of X and Y, respectively.

For example, extractor 400 may include a contrast function estimator 406 to estimate the contrast function $\phi[\hat{S}(z)]$ based on the output of extractor 402, e.g., in accordance with Equation 9. The contrast function $\phi[\hat{S}(z)]$ may reach a minimum, for example, when extraction/separation is achieved, for example, since the separation process may be a minimization of mutual information (contrast function) between the outputs of a separation unit. For example, adaptation algorithm 404 may adapt the function $F^{-1}$ by detecting the minimum of the function $\phi[\hat{S}(z)]$.

In one example, the separation matrix B(z) may be determined using a natural gradient iterative algorithm, e.g., as follows:

$$B_n(z) = \left(I - \mu \frac{\partial}{\partial B_n(z)} \phi[\hat{S}(z)]\right) B_n(z) \tag{11}$$

wherein μ denotes a learning rate, e.g., an iteration step.

Referring back to FIG. 3, in other embodiments, controller 300 may not include extractor 306. Accordingly, input 308 may include inputs 304 and/or any other input based on inputs 304.

In some demonstrative embodiments, estimator 310 may apply any suitable linear and/or non-linear function to input 308. For example, the estimation function may include a non-linear estimation function, e.g., a radial basis function.

In some demonstrative embodiments, estimator 310 may be able to adapt one or more parameters of the estimation function based on a plurality of residual-noise inputs 316 representing acoustic residual-noise at a plurality of predefined residual-noise sensing locations, which are located within the noise-control zone. For example, inputs 316 may include inputs 106 (FIG. 1) representing acoustic residual-noise at residual-noise sensing locations 107 (FIG. 2), which are located within noise-control zone 110 (FIG. 2).

In some demonstrative embodiments, one or more of inputs 316 may include at least one virtual microphone input corresponding to a residual noise ("noise error") sensed by at least one virtual error sensor at at least one particular residual-noise sensor location of locations 107 (FIG. 2). For example, controller 300 may evaluate the noise error at the particular residual-noise sensor location based on inputs 308 and the predicted noise signal 312, e.g., as described below.

In one example, controller 300 may utilize a speaker transfer function to produce an estimation of a noise control pattern generated by transducer 314, e.g., by applying the speaker transfer function to predicted noise signal 312. Controller 300 may also utilize a modulation transfer function to produce an estimation of the noise pattern at the particular residual-noise sensor location, e.g., by applying the modulation transfer function to the noise signal represented by input 308. Controller 300 may determine the estimated residual noise at the particular residual-noise sensor location, for example, by subtracting the estimation of the noise control pattern from the estimation of the noise pattern.

In some demonstrative embodiments, controller 300 may estimate a sample ("the succeeding sample") of the noise pattern succeeding a current sample of the noise pattern, for example, based on the current sample and/or one or more previous samples of the noise pattern. Controller 300 may provide noise control signal 312, such that transducer 312 may produce the noise control pattern based on the estimated succeeding sample, e.g., such that the noise control pattern may reach the particular residual-noise sensor location substantially at the same time the noise pattern reaches the same particular residual-noise sensor location.

In some demonstrative embodiments, estimator 310 may include a multi-input-multi-output (MIMO) prediction unit configured, for example, to generate a plurality of noise control patterns corresponding to the n-th sample, e.g., including M control patterns, denoted $y_1(n) \ldots y_M(n)$, to drive a plurality of M respective acoustic transducers, e.g., based on the inputs 308.

Figure 5:
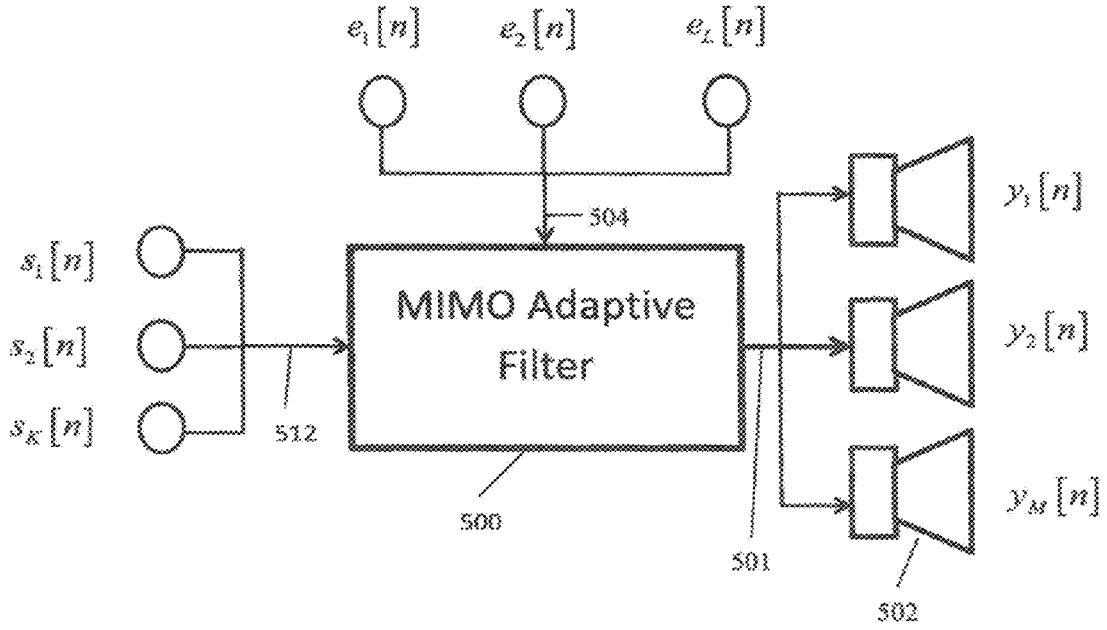
FIG. 5 is a schematic block diagram illustration of a multi-input-multi-output prediction unit, in accordance with some demonstrative embodiments.

Reference is now made to FIG. 5, which schematically illustrates a MIMO prediction unit 500, in accordance with some demonstrative embodiments. In some demonstrative embodiments, MIMO prediction unit 500 may perform the functionality of estimator 310 (FIG. 3).

As shown in FIG. 4, prediction unit 500 may be configured to receive an input 502 including the vector $\hat{S}[n]$, e.g., as output from extractor 306 (FIG. 3), and to drive loudspeaker array 502 including M acoustic transducers. For example, prediction unit 500 may generate a controller output 501 including the M noise control patterns $y_1(n) \ldots y_M(n)$, to drive a plurality of M respective acoustic transducers, e.g., based on the inputs 308.

In some demonstrative embodiments, interference (cross-talk) between two or more of the M acoustic transducers of array 502 may occur, for example, when two or more, e.g., all of, the M acoustic transducers generate the control noise pattern, e.g., simultaneously.

In some demonstrative embodiments, prediction unit 500 may generate output 501 configured to control array 502 to generate a substantially optimal noise control pattern, e.g., while simultaneously optimizing the input signals to each speaker in array 502. For example, prediction unit 500 may control the multi-channel speakers of array 502, e.g., while cancelling the interface between the speakers.

In one example, prediction unit 500 may utilize a linear function with memory. For example, prediction unit 500 may determine a noise control pattern, denoted $y_m[n]$, corresponding to an m-th speaker of array 502 with respect to the n-th sample of the primary pattern, e.g., as follows:

$$y_m[n] = \sum_{k=1}^{K} \sum_{i=1}^{I-1} w_{km}[i] s_k[n-i] \tag{12}$$

wherein $s_k[n]$ denotes the k-th disjoint reference acoustic pattern, e.g., received from extractor 306 (FIG. 3), and $w_{km}[i]$ denotes a prediction filter coefficient configured to drive the m-th speaker based on the k-th disjoint reference acoustic pattern, e.g., as described below.

In another example, prediction unit 500 may implement any other suitable prediction algorithm, e.g., linear, or non-linear, having or not having memory, and the like, to determine the output 501.

In some demonstrative embodiments, prediction unit 500 may optimize the prediction filter coefficients $w_{km}[i]$, for example, based on a plurality of a plurality of residual-noise inputs 504, e.g., including a plurality of residual-noise inputs 316. For example, prediction unit 500 may optimize the prediction filter coefficients $w_{km}[i]$ to achieve maximal destructive interference at the residual-error sensing locations 107 (FIG. 2). For example, locations 107 may include L locations, and inputs 504 may include L residual noise components, denoted $e_1[n], e_2[n], \ldots, e_L[n]$.

In some demonstrative embodiments, prediction unit 500 may optimize the prediction filter coefficients $w_{km}[i]$ based, for example, on a minimum mean square error (MMSE) criterion, or any other suitable criteria. For example, a cost function, denoted J, for optimization prediction filter coefficients $w_{km}[i]$ may be defined, for example, as a total energy of the residual noise components $e_1[n], e_2[n], \ldots, e_L[n]$ at locations 107 (FIG. 2), e.g., as follows:

$$J = E\left\{\sum_{l=1}^{L} e_l^2[n]\right\} \tag{13}$$

In some demonstrative embodiments, a residual noise pattern, denoted $e_l[n]$, at an l-th location may be expressed, for example, as follows:

$$e_l[n] = d_l[n] - \sum_{m=1}^{M} \sum_{j=0}^{J-1} stf_{lm}[j] \cdot y_m[n-j] = d_l[n] - \sum_{m=1}^{M} \sum_{j=0}^{J-1} stf_{lmj}[j] \cdot \sum_{k=1}^{K} \sum_{i=1}^{I-1} w_{km}[i] s_k[n-i] \tag{14}$$

wherein $stf_{lm}[j]$ denotes a path transfer function having J coefficients from the m-th speaker of the array 502 at a l-th location; and $w_{km}[n]$ denotes an adaptive weight vector of the prediction filter with I coefficients representing the relationship between the k-th reference acoustic pattern $s_k[n]$ and the control signal of the m-th speaker.

In some demonstrative embodiments, prediction unit 500 may optimize the adaptive weights vector $w_{km}[n]$, e.g., to reach an optimal point, e.g., a maximal noise reduction. For example, prediction unit 500 may implement a gradient based adaption method, when at each step the weight vector $w_{km}[n]$ is updated in a negative direction of a gradient of the cost function J, e.g., as follows:

$$w_{km}[n+1] = w_{km}[n] - \frac{\mu_{km}}{2} \cdot \nabla J_{km} \tag{15}$$

$$\nabla J_{km} = -2 \sum_{l=1}^{L} e_l[n] \sum_{i=1}^{I-1} stf_{km}[n] x_k[n-i]$$

$$w_{km}[n+1] = w_{km}[n] + \mu_{km} \cdot \sum_{l=1}^{L} e_l[n] \sum_{i=1}^{I-1} stf_{km}[n] x_k[n-i]$$

Referring back to FIG. 3, in some demonstrative embodiments, controller 300 100 may be implemented to alter, modify and/or control one or more acoustic attributes within a noise control zone, e.g., zone 110 (FIG. 2). Following are only some demonstrative implementations of controller 300.

In some demonstrative embodiments, controller 300 may be implemented to reduce unwanted noise in a vehicle. In one example, a plurality of acoustic pattern "types" may be present within the vehicle, e.g., an audio system signal, a horn, a siren, road noise and/or wind noise, which may take place simultaneously.

Extractor 306 may be configured to disaggregate the different noise patterns and to provide to estimator 310 input 308 including only one or more of the unwanted noise patterns, e.g., the road noise pattern and/or the wind noise pattern. Accordingly, estimator 310 may control transducer 314 to generate a noise control pattern, which will affect other "wanted" noise patterns, e.g., the audio pattern, while reducing and/or eliminating the one or more unwanted noise patterns.

In some demonstrative embodiments, controller 300 may be implemented in a bedroom scenario, e.g., such that a snoring acoustic "pattern" may be disaggregated form an acoustic pattern of an alarm. Accordingly, controller 300 may allow reducing and/or eliminating the snoring acoustic patent, while not affecting the clock acoustic pattern.

Figure 6:
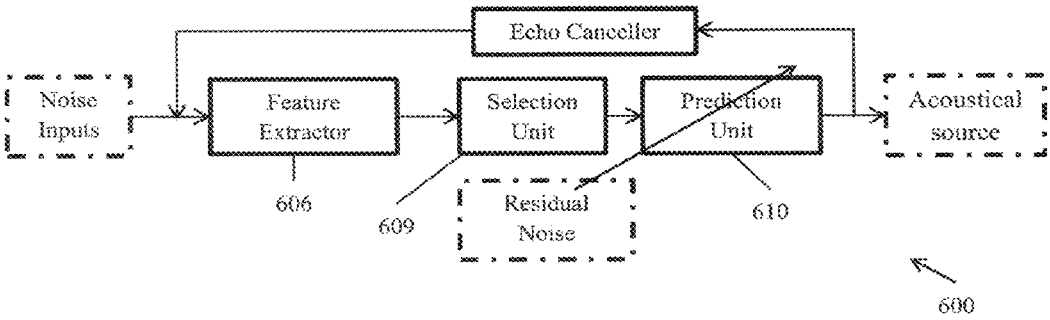
FIG. 6 is a schematic block diagram illustration of a controller including a noise pattern selector, in accordance with some demonstrative embodiments.

In some demonstrative embodiments, controller 300 may be configured to select one or more of the noise patterns to be controlled by controller 300. For example, as shown in FIG. 6, a controller 600 may include a selection unit 609, e.g., between an extractor 606 and a prediction unit 610. Selection unit 609 may selectively provide to prediction unit 610 only signals with special interest, e.g., based on a predefined criterion. For example, a possible criterion could be specific spectral or temporal behavior. For example, if the signal to be controlled does not overlap with the signal that is not to be controlled in a frequency domain, then selector 609 may separate the signals, e.g., by using a filter bank approach utilizing a plurality of filters to filter the frequencies of the signal to be controlled.

Figure 7:
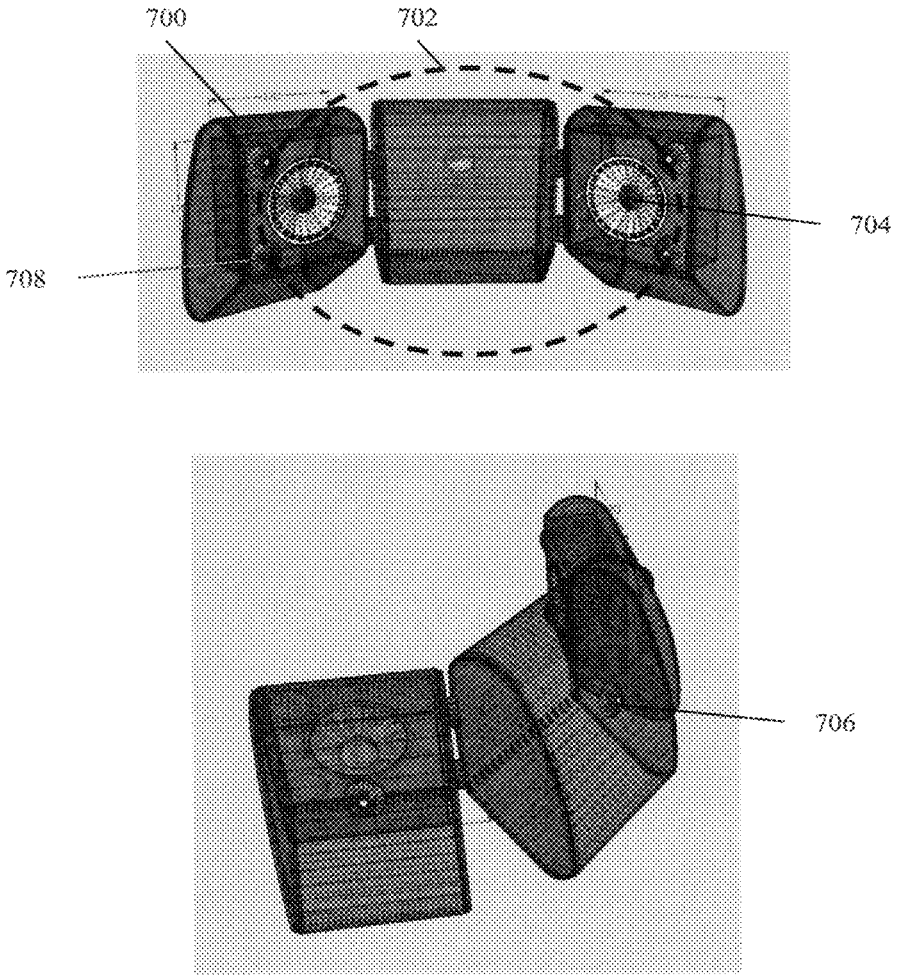
FIG. 7 is a conceptual illustration of a headrest ANC system, in accordance with some demonstrative embodiments.

FIG. 7 illustrates front and back views of a conceptual deployment of a headrest ANC system 700 configured to maintain a Quiet Bubble 702 around a head of a user of headrest 700, in accordance with some demonstrative embodiments. As shown in FIG. 7, headrest ANC system 700 may include two or more acoustic transducers, e.g., two transducers 704 positioned on both sides of the headrest, one or more reference sensors, e.g., three reference sensors 706 positioned outside the Quiet Bubble 702, e.g., on a back of the headrest, and two or more residual-noise sensors, e.g., four sensors 708 positioned inside the Quiet Bubble 700.

Figure 8:
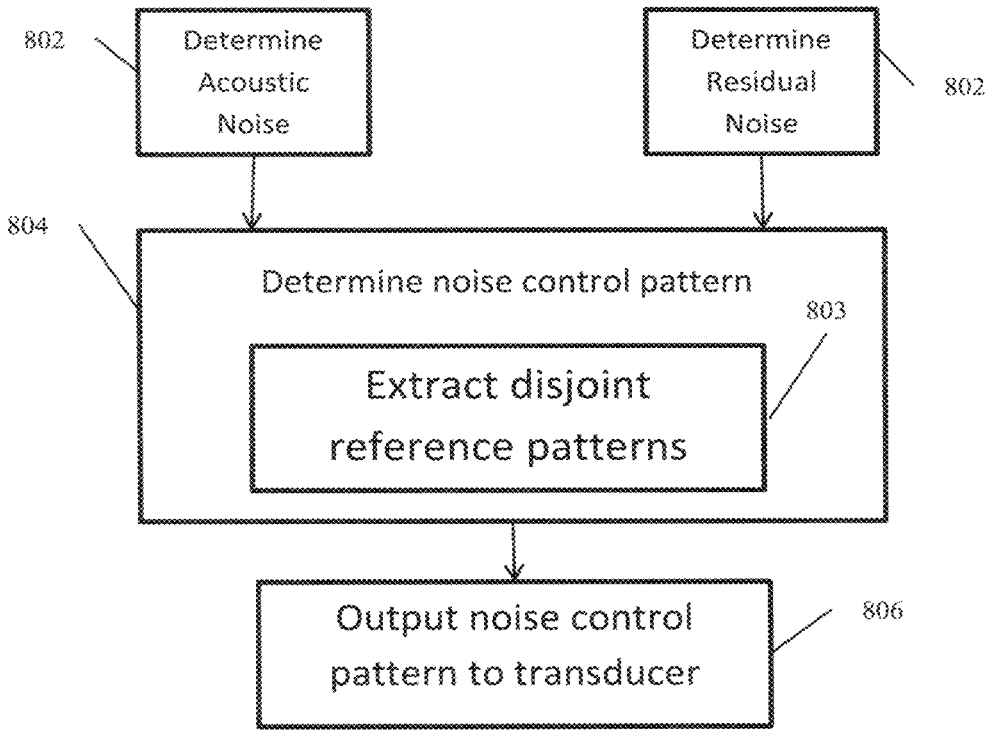
FIG. 8 is a schematic flow-chart illustration of a method of noise control, in accordance with some demonstrative embodiments.

FIG. 8 is a schematic flow-chart illustration of a method of noise control, in accordance with some demonstrative embodiments. In some demonstrative embodiments, one or more operations of the method of FIG. 8 may be performed by an ANC system e.g., system 100 (FIG. 1), a controller, e.g., controller 300 (FIG. 3) and/or any other component of an ANC system.

As indicated at block 800, the method may include determining acoustic noise at a plurality of predefined noise sensing locations, which are defined with respect to a predefined noise-control zone. For example, controller 102 (FIG. 1) may receive noise inputs 104 (FIG. 1) corresponding to locations 105 (FIG. 2) with respect to noise control zone 110 (FIG. 2). For example, inputs 104 (FIG. 1) may be determined based on inputs from one or more real and/or virtual noise sensors, e.g., as described above.

As indicated at block 802, the method may include determining acoustic residual-noise at a plurality of predefined residual-noise sensing locations, which are located within the predefined noise-control zone. For example, controller 102 (FIG. 1) may receive residual noise inputs 106 (FIG. 1) corresponding to locations 107 (FIG. 2) with respect to noise control zone 110 (FIG. 2). For example, inputs 106 (FIG. 1) may be determined based on inputs from one or more real and/or virtual noise sensors, e.g., as described above.

As indicated at block 804, the method may include determining a noise control pattern to control the acoustic noise within the noise-control zone, based on the acoustic noise at the plurality of predefined noise sensing locations and the acoustic residual-noise at the plurality of predefined residual-noise sensing locations. For example, controller 102 (FIG. 1) may determine noise control signal 109 (FIG. 1), based on noise inputs 104 (FIG. 1) and residual-noise inputs 106 (FIG. 1), e.g., as described above.

As indicated at block 806, the method may include outputting the noise control pattern to at least one acoustic transducer. For example, controller 102 (FIG. 1) may output signal 109 to control acoustic transducer 108, e.g., as described above.

As indicated at block 803, the method may include extracting from the plurality of noise inputs a plurality of disjoint reference acoustic patterns, which are statistically independent with respect to at least one predefined attribute. For example, extractor 306 (FIG. 3) may extract the plurality of disjoint reference acoustic patterns, e.g., as described above. For example, determining the noise control pattern may include determining the noise control pattern based on at least one disjoint reference acoustic pattern of the plurality of disjoint reference acoustic patterns, e.g., as described above.

Figure 9:
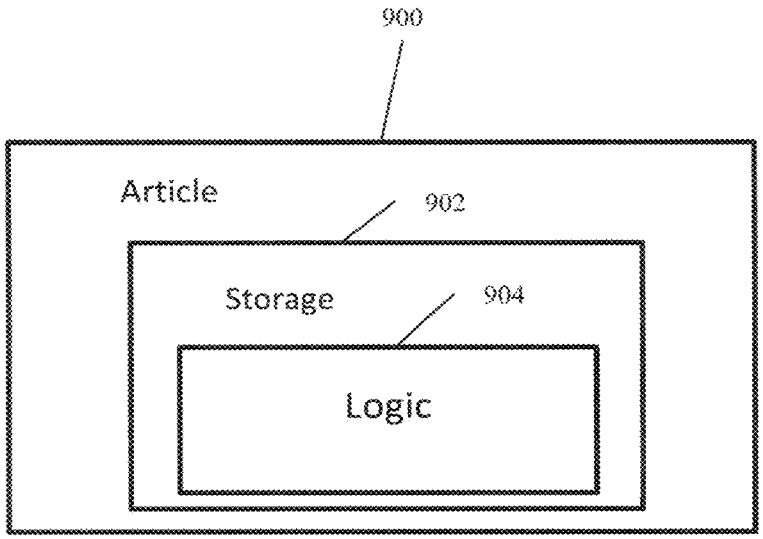
FIG. 9 is a schematic block diagram illustration of an article of manufacture, in accordance with some demonstrative embodiments.

Reference is made to FIG. 9, which schematically illustrates an article of manufacture 900, in accordance with some demonstrative embodiments. Article 900 may include a non-transitory machine-readable storage medium 902 to store logic 904, which may be used, for example, to perform at least part of the functionality of controller 102 (FIG. 1) and/or to perform one or more operations of the method of FIG. 8. The phrase "non-transitory machine-readable medium" is directed to include all computer-readable media, with the sole exception being a transitory propagating signal.

In some demonstrative embodiments, article 900 and/or machine-readable storage medium 902 may include one or more types of computer-readable storage media capable of storing data, including volatile memory, non-volatile memory, removable or non-removable memory, erasable or non-erasable memory, writeable or re-writeable memory, and the like. For example, machine-readable storage medium 902 may include, RAM, DRAM, Double-Data-Rate DRAM (DDR-DRAM), SDRAM, static RAM (SRAM), ROM, programmable ROM (PROM), erasable programmable ROM (EPROM), electrically erasable programmable ROM (EEPROM), Compact Disk ROM (CD-ROM), Compact Disk Recordable (CD-R), Compact Disk Rewriteable (CD-RW), flash memory (e.g., NOR or NAND flash memory), content addressable memory (CAM), polymer memory, phase-change memory, ferroelectric memory, silicon-oxide-nitride-oxide-silicon (SONOS) memory, a disk, a floppy disk, a hard drive, an optical disk, a magnetic disk, a card, a magnetic card, an optical card, a tape, a cassette, and the like. The computer-readable storage media may include any suitable media involved with downloading or transferring a computer program from a remote computer to a requesting computer carried by data signals embodied in a carrier wave or other propagation medium through a communication link, e.g., a modem, radio or network connection.

In some demonstrative embodiments, logic 904 may include instructions, data, and/or code, which, if executed by a machine, may cause the machine to perform a method, process and/or operations as described herein. The machine may include, for example, any suitable processing platform, computing platform, computing device, processing device, computing system, processing system, computer, processor, or the like, and may be implemented using any suitable combination of hardware, software, firmware, and the like.

In some demonstrative embodiments, logic 904 may include, or may be implemented as, software, a software module, an application, a program, a subroutine, instructions, an instruction set, computing code, words, values, symbols, and the like. The instructions may include any suitable type of code, such as source code, compiled code, interpreted code, executable code, static code, dynamic code, and the like. The instructions may be implemented according to a predefined computer language, manner or syntax, for instructing a processor to perform a certain function. The instructions may be implemented using any suitable high-level, low-level, object-oriented, visual, compiled and/or interpreted programming language, such as C, C++, Java, BASIC, Matlab, Pascal, Visual BASIC, assembly language, machine code, and the like.

Functions, operations, components and/or features described herein with reference to one or more embodiments, may be combined with, or may be utilized in combination with, one or more other functions, operations, components and/or features described herein with reference to one or more other embodiments, or vice versa.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

What is claimed is:

1. An active noise control system comprising:

an input configured to receive a plurality of noise inputs representing acoustic noise at a plurality of predefined noise sensing locations, which are defined with respect to a predefined noise-control zone;

a controller configured to control noise within the predefined noise-control zone, said controller is configured to receive the plurality of noise inputs, to receive a plurality of residual-noise inputs representing acoustic residual-noise at a plurality of predefined residual-noise sensing locations, which are located within said predefined noise-control zone, and to determine a noise control pattern, based on said plurality of noise inputs and said plurality of residual-noise inputs, said controller comprises an extractor component configured to extract from said plurality of noise inputs a plurality of disjoint reference acoustic patterns, which are statistically independent, wherein said controller is configured to select at least one disjoint reference acoustic pattern from said plurality of disjoint reference acoustic patterns based on one or more predefined acoustic pattern attributes of at least one predefined noise pattern to be controlled within said noise-control zone, the controller is configured to determine said noise control pattern based on the at least one disjoint reference acoustic pattern selected from the plurality of disjoint reference acoustic patterns; and an output to output said noise control pattern to at least one acoustic transducer.

2. The active noise control system of claim 1, wherein said one or more acoustic pattern attributes comprise at least one attribute selected from a group consisting of amplitude, energy, phase, frequency, direction, and statistical properties.

3. The active noise control system of claim 1, wherein said controller is to extract said plurality of disjoint reference acoustic patterns by applying a predefined extraction function to said plurality of noise inputs.

4. The active noise control system of claim 1, wherein said controller is to determine said noise control pattern to reduce at least one noise parameter within said noise-control zone, the noise parameter including at least one parameter selected from a group consisting of energy and amplitude.

5. The active noise control system of claim 1, wherein said controller is to determine said noise control pattern to selectively reduce one or more predefined first noise patterns within said noise-control zone, while not reducing one or more second noise patterns within said noise-control zone.

6. The active noise control system of claim 5, wherein said noise-control zone is located within an interior of a vehicle, wherein said one or more first noise patterns comprise at least one pattern selected from a group consisting of a road noise pattern, a wind noise pattern, and an engine noise pattern, and wherein said one or more first noise patterns comprise at least one pattern selected from a group consisting of an audio noise pattern of an audio device located within said vehicle, a horn noise pattern, a siren noise pattern, a functional signal, and a hazard signal.

7. The active noise control system of claim 1, wherein said controller is to determine said noise control pattern without having information relating to one or more noise-source attributes of one or more actual noise sources generating the acoustic noise at said plurality of predefined noise sensing locations.

8. The active noise control system of claim 7, wherein said noise-source attributes include at least one attribute selected from a group consisting of a number of said noise sources, a location of said noise sources, a type of said noise sources, and one or more attributes of one or more noise patterns generated by one or more of said noise sources.

9. The active noise control system of claim 1, wherein said noise sensing locations are distributed on an enclosure surrounding said noise-control zone.

10. The active noise control system of claim 1 comprising:

one or more first acoustic sensors to sense the acoustic noise at one or more of said plurality of noise sensing locations; and one or more second acoustic sensors to sense the acoustic residual-noise at one or more of said plurality of residual-noise sensing locations.

11. A method of active noise control, the method comprising:

determining acoustic noise at a plurality of predefined noise sensing locations, which are defined with respect to a predefined noise-control zone;

extracting from said acoustic noise a plurality of disjoint reference acoustic patterns, which are statistically independent;

selecting at least one disjoint reference acoustic pattern from said plurality of disjoint reference acoustic patterns based on one or more predefined acoustic pattern attributes of at least one predefined noise pattern to be controlled within said noise-control zone;

determining acoustic residual-noise at a plurality of predefined residual-noise sensing locations, which are located within said predefined noise-control zone;

determining a noise control pattern to control the acoustic noise within said noise-control zone, based on the acoustic noise at the plurality of predefined noise sensing locations and the acoustic residual-noise at the plurality of predefined residual-noise sensing locations, wherein determining said noise control pattern comprises determining said noise control pattern based on the at least one disjoint reference acoustic pattern selected from the plurality of disjoint reference acoustic patterns; and outputting said noise control pattern to at least one acoustic transducer.

12. The method of claim 11 comprising extracting said plurality of disjoint reference acoustic patterns by applying a predefined extraction function to a plurality of noise inputs representing said acoustic noise.

13. The method of claim 11, wherein determining said noise control pattern comprises determining said noise control pattern to reduce at least one noise parameter within said noise-control zone, the noise parameter including at least one parameter selected from a group consisting of energy and amplitude.

14. The method of claim 11, wherein determining said noise control pattern comprises determining said noise control pattern to selectively reduce one or more predefined first noise patterns within said noise-control zone, while not reducing one or more second noise patterns within said noise-control zone.

15. The method of claim 11, wherein determining said noise control pattern comprises determining said noise control pattern without having information relating to one or more noise-source attributes of one or more actual noise sources generating the acoustic noise at said plurality of predefined noise sensing locations.

16. The method of claim 11, wherein said noise sensing locations are distributed on an enclosure surrounding said noise-control zone.

17. A method of active noise control, the method comprising:

determining a noise control pattern to control acoustic noise within a predefined noise-control zone, based on a plurality of noise inputs representing acoustic noise at a plurality of predefined noise sensing locations, which are defined with respect to said predefined noise-control zone, and acoustic residual-noise at a plurality of predefined residual-noise sensing locations, which are located within said predefined noise-control zone, wherein determining the noise control pattern comprises extracting from the plurality of noise inputs a plurality of disjoint reference acoustic patterns, which are statistically independent, selecting at least one disjoint reference acoustic pattern from said plurality of disjoint reference acoustic patterns based on one or more predefined acoustic pattern attributes of at least one predefined noise pattern to be controlled within said noise-control zone, and determining said noise control pattern based on the at least one disjoint reference acoustic pattern selected from the plurality of disjoint reference acoustic patterns; and outputting said noise control pattern to at least one acoustic transducer.

18. The method of claim 17 comprising extracting said plurality of disjoint reference acoustic patterns by applying a predefined extraction function to said plurality of noise inputs.

19. The method of claim 17, wherein determining said noise control pattern comprises determining said noise control pattern to selectively reduce one or more predefined first noise patterns within said noise-control zone, while not reducing one or more second noise patterns within said noise-control zone.

20. A product including a non-transitory storage medium having stored thereon instructions that, when executed by a machine, result in:

determining a noise control pattern to control acoustic noise within a predefined noise-control zone, based on a plurality of noise inputs representing acoustic noise at a plurality of predefined noise sensing locations, which are defined with respect to said predefined noise-control zone, and acoustic residual-noise at a plurality of predefined residual-noise sensing locations, which are located within said predefined noise-control zone, wherein determining the noise control pattern comprises extracting from the plurality of noise inputs a plurality of disjoint reference acoustic patterns, which are statistically independent, selecting at least one disjoint reference acoustic pattern from said plurality of disjoint reference acoustic patterns based on one or more predefined acoustic pattern attributes of at least one predefined noise pattern to be controlled within said noise-control zone, and determining said noise control pattern based on the at least one disjoint reference acoustic pattern selected from the plurality of disjoint reference acoustic patterns; and outputting said noise control pattern to at least one acoustic transducer.

21. The product of claim 20, wherein said instructions result in extracting said plurality of disjoint reference acoustic patterns by applying a predefined extraction function to said plurality of noise inputs.

* * * * *